United States Patent [19]

Hall

[11] Patent Number: 4,480,810

[45] Date of Patent: Nov. 6, 1984

[54] LADDER CADDY

[76] Inventor: Jeffrey J. Hall, 8479 Road 153, East Liberty, Ohio 43319

[21] Appl. No.: 453,717

[22] Filed: Dec. 27, 1982

[51] Int. Cl.[3] ..... E06C 7/14

[52] U.S. Cl. ..... 248/238; 248/231.4; 248/231.6; 182/129

[58] Field of Search ..... 248/210, 238, 226.1, 248/226.3, 318; 15/257.06; 182/120, 121, 122, 129

[56] References Cited

U.S. PATENT DOCUMENTS 768,364 8/1904 Hines ..... 248/210

FOREIGN PATENT DOCUMENTS 627519 9/1961 Canada ..... 182/129

779845 1/1935 France ..... 248/210

*Primary Examiner*—Reinaldo P. Machado

*Attorney, Agent, or Firm*—Fay & Sharpe

[57] ABSTRACT

A ladder caddy particularly adapted for attachment to a step or extension ladder for containing work implements is provided. The ladder caddy comprises a container member including side edge portions adapted to engage associated ladder side rails, and a clamping member depending from the container member for clamping the ladder caddy to a ladder. The clamping member includes a first portion comprising a first support shoulder and first support flange generally normally depending therefrom, and a second portion selectively adjustable to the first portion comprising a second support shoulder generally opposite of the first support shoulder and a second support flange generally normally depending from the second support shoulder. Means are provided for selectively fastening the clamping member first portion to the clamping member second portion whereby the ladder caddy may be attached to a ladder.

10 Claims, 8 Drawing Figures

FIG. 5
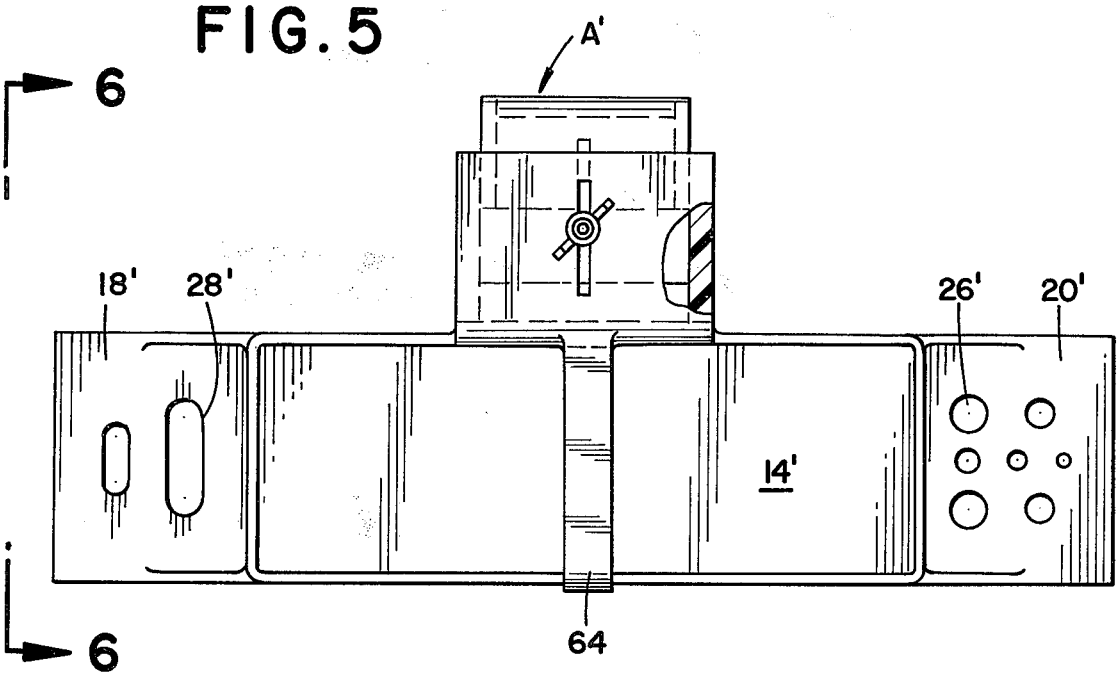
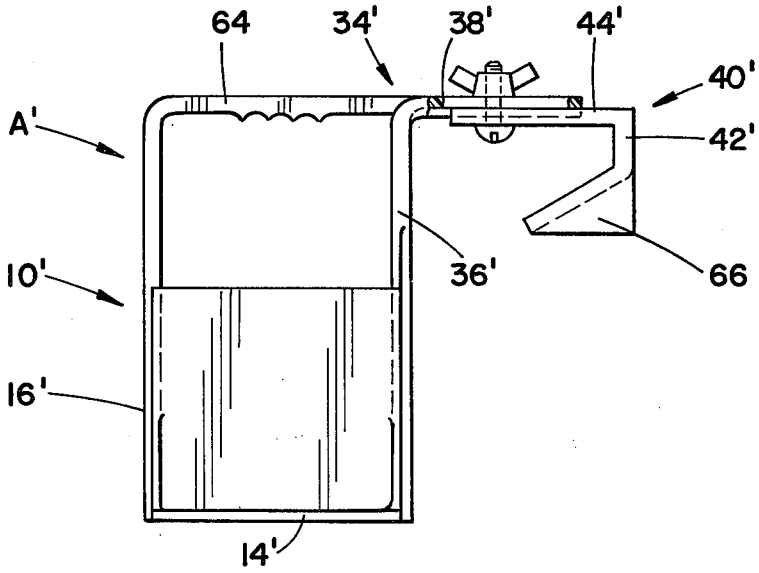
FIG. 6

LADDER CADDY

BACKGROUND OF THE INVENTION

This invention pertains to the art of ladder attachment devices and more particularly to a container device attachable to the rungs of an extension ladder or to the steps of a step ladder.

The invention is particularly applicable to a container and clamping device for containing work implements typically used in work on a ladder such as paint cans, paint brushes or other hardware tools, bottles or fixtures. However, it will be appreciated to those skilled in the art that the invention could be readily adapted for other uses in other environments as, for example, where similar container devices are employed to contain other types of materials.

When engaged in typical work practices employing a ladder such as painting, scraping, applying putty or the like, it is hazardous and inconvenient for one to have to carry the work implements manually or in personal pockets while performing the work. Such practices can be particularly dangerous at heights well within the range of conventional type ladders.

Various forms and types of ladder attachments have been heretofore suggested and employed all with varying degrees of success. It has been found that defects present in most prior ladder attachment container devices are such that the devices themselves are of limited economic and practical value.

Most prior ladder attachment container devices have comprised tray configurations limited to attachment to the rungs of an inclined extension ladder. The means of attachment generally comprise hooks which are attached to the rung for suspending the tray. The hooks remain attached to the rungs due to mere gravitational forces and are not positively clamped such that when moving the ladder it is therefore necessary to remove the tray. In addition, the hooks are limited to attachment to rungs of a ladder and are not adjustable for use with steps on a step ladder.

Another particular problem with most conventional tray attachments is that the tray positioning is controlled by the incline of the ladder to which the tray is attached and thus, the tray may be inclined such that cans of paint or other materials which are most advantageously employed when resting on a completely level surface are easily upset.

The present invention contemplates a new and improved container and clamping device for attachment to a ladder which overcomes all of the above referred to problems and others to provide a new ladder caddy device which is simple in design, economical to manufacture, readily adaptable to a plurality of uses with ladders having a variety of dimensional characteristics, easy to attach and lock in place, easy to remove and transport and which provides improved containment facilities for work implements and fixtures.

BRIEF SUMMARY OF THE INVENTION

In accordance with the present invention, there is provided a container and clamping device for a ladder comprising a container member and a clamping member depending from the container member. The container member is configured for containing work implements and includes side edge portions adapted to engage ladder side rails. The clamping member includes a first portion comprising a first support shoulder and a first support flange generally normally depending from the support shoulder, and a second portion selectively adjustable to the first portion comprising a second support shoulder generally opposite of the first support shoulder and a second support flange generally normally depending from the second support shoulder. Means are provided for selectively fastening the clamping member first portion to the clamping member second portion whereby the container and clamping device may be attached to a ladder.

In accordance with another aspect of the present invention the first support flange includes a first extended slot and the second support flange includes a second extended slot disposed for underlying positioning to the first extended slot. The slots are configured for receiving the means for selectively fastening and for aligning the first portion of the clamping member to the second portion clamping member.

In accordance with a further aspect of the present invention the edge portions of the container comprise first and second outwardly extending panels including a plurality of ringlets for receiving tools.

In accordance with a more limited aspect of the present invention, the container member includes a hand hold for portable transport.

In accordance with yet another more limited aspect of the present invention the clamping member includes a tapered retaining lip generally normally depending from the second support shoulder opposite of the second support flange.

One benefit obtained by use of the present invention is a container and clamping device which is adjustable and attachable to a variety of ladder types having a variety of dimensions.

Another benefit obtained from the present invention is a ladder caddy device which provides an improved container for common work implements such as hardware, tools, bottles or fixtures that is positively clamped to a ladder such that the ladder may be moved or stored while the invention remains attached.

A further benefit of the present invention is a ladder caddy device which is adjustable relative to the incline of the ladder for leveling the container so that items contained in the container may rest upon a level surface.

Yet another benefit of the present invention is a simple clamping device that is fully adjustable and reversible. The clamping device inhibits accidential dislodgement of the invention and is configured to permit attachment to the rungs or steps of any conventional ladder.

Other benefits and advantages for the subject new ladder caddy will become apparent to those skilled in the art upon a reading and understanding of this specification.

BRIEF DESCRIPTION OF THE DRAWINGS

The invention may take physical form in certain parts and arrangement of parts, the preferred and an alternative embodiment of which will be described in detail in this specification and illustrated in the accompanying drawings which form a part hereof and wherein:

FIG. 5 is a plan view showing an alternative embodiment of the present invention;

FIG. 6 is an end view taken along line 6—6 of FIG. 5;

DETAILED DESCRIPTION OF THE INVENTION

Figure 1:
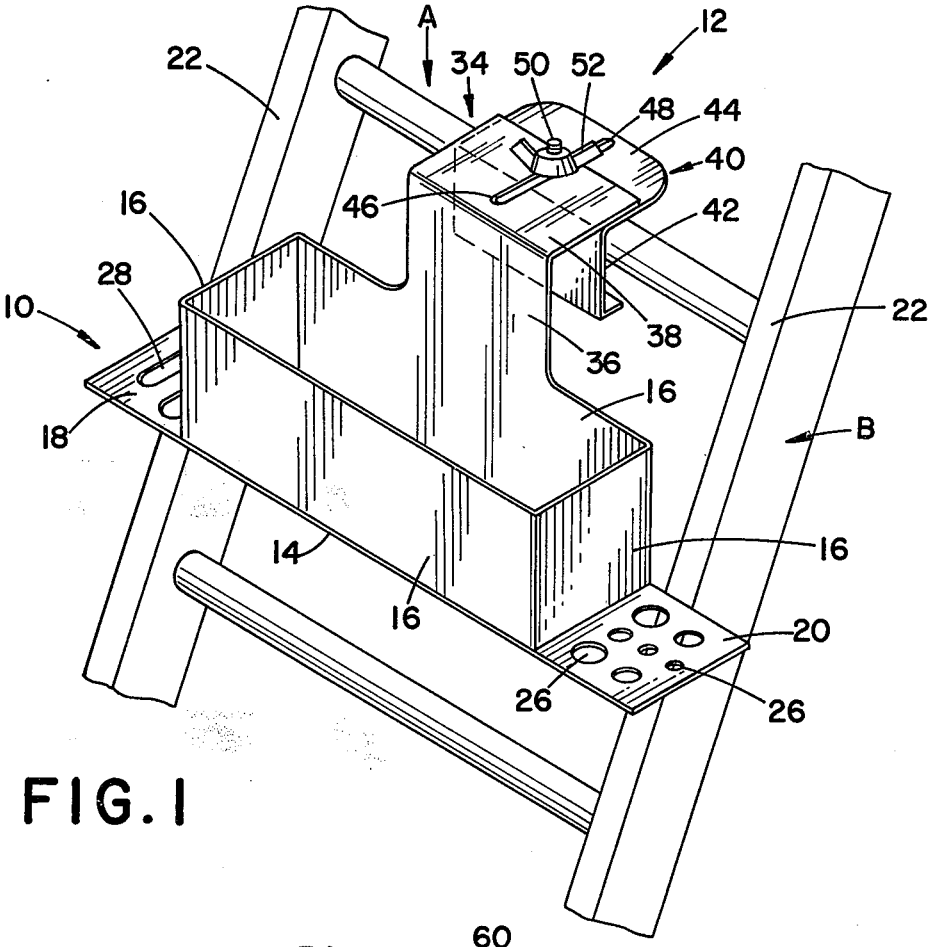
FIG. 1 is a perspective view of a ladder caddy formed in accordance with the present invention showing it in position on a conventional extension ladder.
Figure 2:
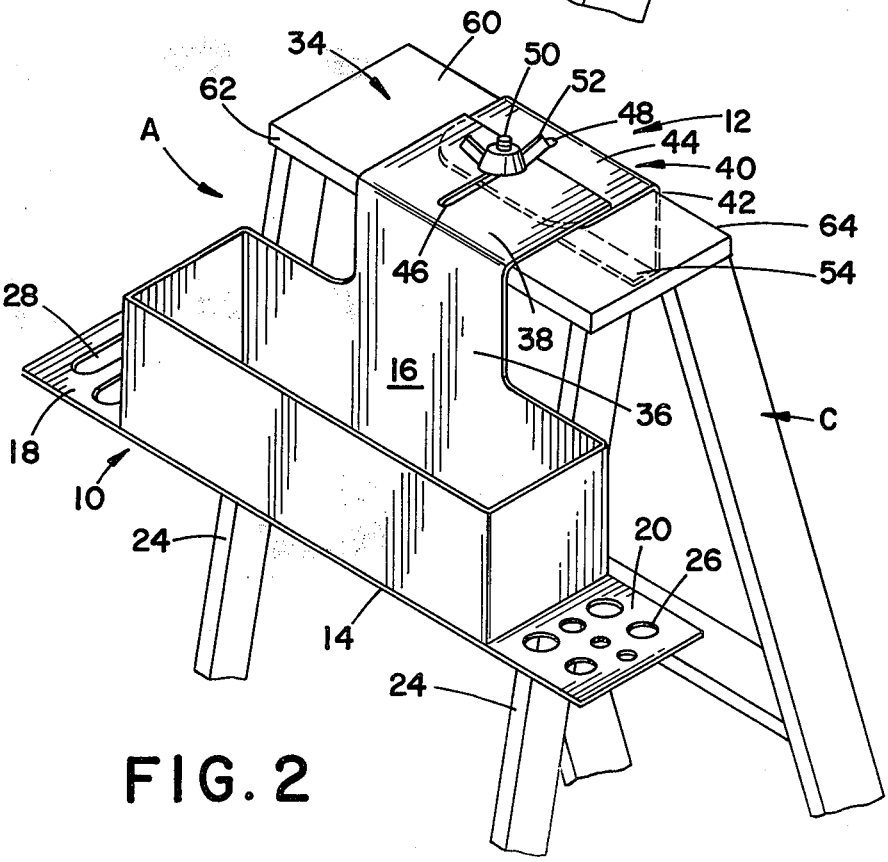
FIG. 2 is a perspective view of a ladder caddy formed in accordance with the present invention showing it in position on a conventional step ladder.
Figure 3:
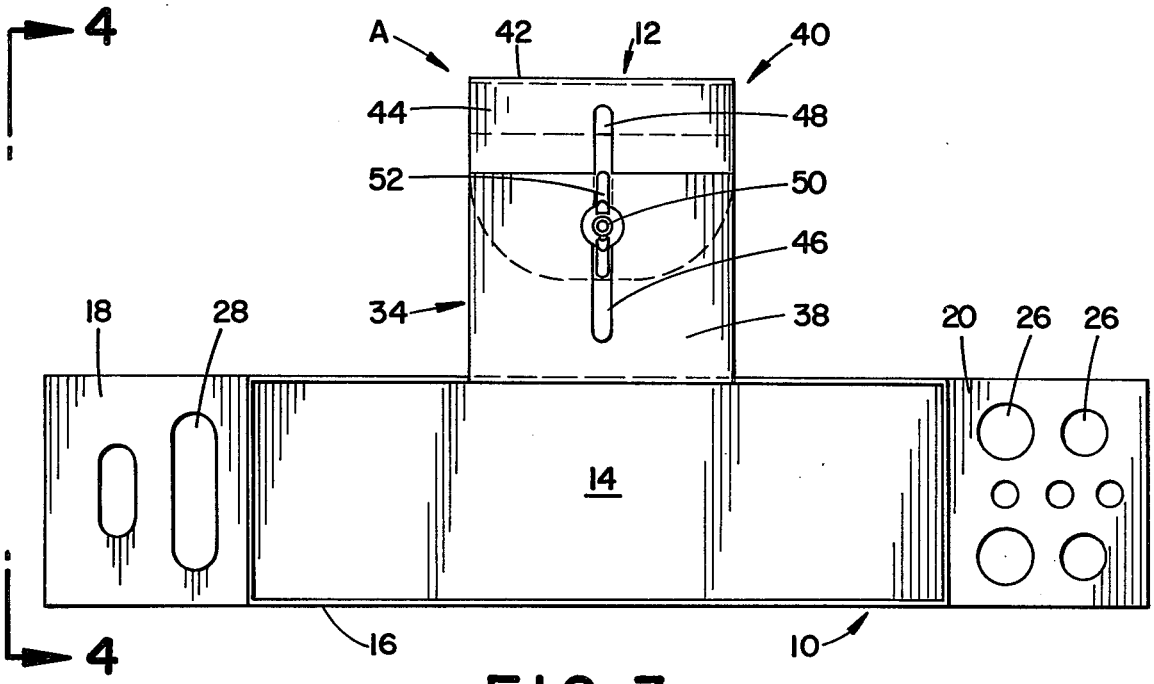
FIG. 3 is a plan view of a ladder caddy formed in accordance with the present invention.
Figure 4:
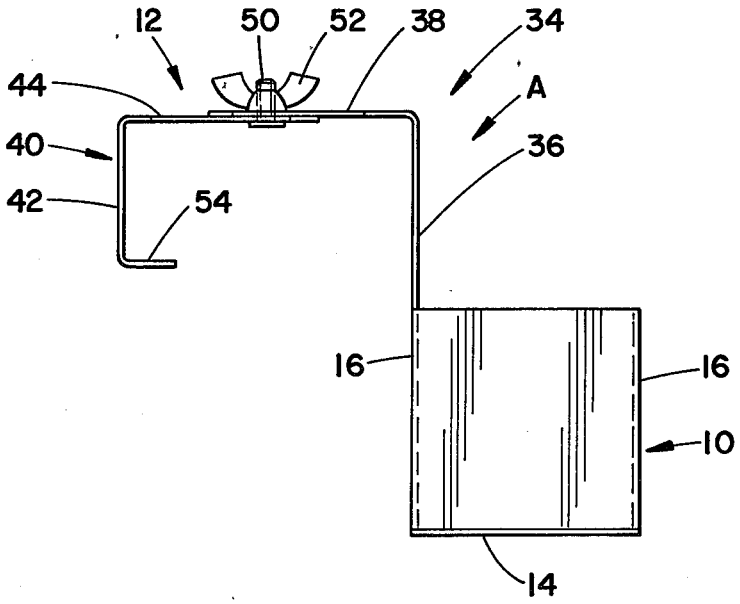
FIG. 4 is an end view taken along line 4—4 of FIG. 3.

Referring now to the drawings wherein the showings are for purposes of illustrating the preferred and one alternative embodiment of the invention only and not for purposes of limiting same, the FIGURES show a container and clamping device for a ladder or ladder caddy A which is received and attached to an extension ladder B or a step ladder C. More specifically and with reference to FIGS. 1 through 4, ladder caddy A is comprised of a container member 10 and a clamping member 12. Container member 10 is preferably comprised of a base wall 14 and a plurality of side walls 16 for defining a container which may be advantageously employed for receiving common work implements such as hardware, tools, bottles, paint cans or fixtures. Base wall 14 includes edge portions 18,20 which comprise outwardly extending panels that are adapted to engage extension ladder side rails 22 (FIG. 1) or step ladder side rails 24 (FIG. 2). Panels 18 and 20 include a plurality of ringlets 36 and extended receiving apertures 28 which are provided to store paint brushes, screw drivers, hammers and other common hand tools.

Clamping member 12 depends from a side wall 16 of container member 10 and includes a first portion 34 comprising a first support shoulder 36 and a first support flange 38 generally normally depending from the first support shoulder 36. A clamp second portion 40 which is selectively adjustable to the first portion 34 is included and comprises a second support shoulder 42, generally opposite of the first support shoulder 36 and a second support flange 44 generally normally depending from the second support shoulder 42. Support flanges 38,44 each include extended slots 46,48 respectively, disposed for aligning the clamping member first portion 34 to the clamping member second portion 40 and for receiving means for selectively fastening the first portion 34 to the second portion 40. Preferably second portion 40 underlies the first portion 34 such that second portion slot 48 is aligned with the first portion slot 46 to receive a threaded bolt 50 and associated wing nut 52. When the invention is attached to an extension ladder B or a step ladder C the wing nut 52 is preferably disposed above flanges 38,44 to avoid interference with the associated rung of extension ladder B or the step of step ladder C. Clamp second portion 40 preferably includes a retaining lip 54 generally normally depending from second support shoulder 42 opposite of the second support flange 44.

It is a particular feature of the present invention, that it is adjustable and convertible for use with an inclined extension ladder B or a step ladder C. When employed with an inclined extension ladder B, clamping member 12 abuts a rung of ladder B generally at the intersection of second support shoulder 42 to second support flange 44, while flange second support flange 44 and retaining lip 54 are generally directed away from clamping member first portion 34 (FIG. 1). By selective adjustment of clamp second portion 40 relative to clamp first portion 34, container member 10 may be selectively inclined relative to side rails 22 to level base wall 14. For such purposes it may be seen that as the inclined angle between ladder B and a support wall (not shown) becomes greater, the second support shoulder 42 of the clamp second portion 40 need necessarily be further positioned apart from the first support shoulder 36 of the clamp first portion 34 to level the base wall 14. The invention allows ease of such adjustment by mere loosening of wing nut 52 and slideable adjustment of clamp portion first portion 34 relative to clamp second portion 40.

When the invention is employed with a step ladder C (FIG. 2) clamping member 12 is received upon a top step 60 of ladder C and adjusted such that first support shoulder 36 and second support shoulder 42 abut the side edges 62,64 respectively of top step 60. Second support flange 44 and retaining lip 54 are generally directed towards clamping member first portion 34 thus clamping member 12 positively clamps ladder caddy A to the top step 60 such that the caddy may remain attached when the ladder is moved or stored.

Figure 7:
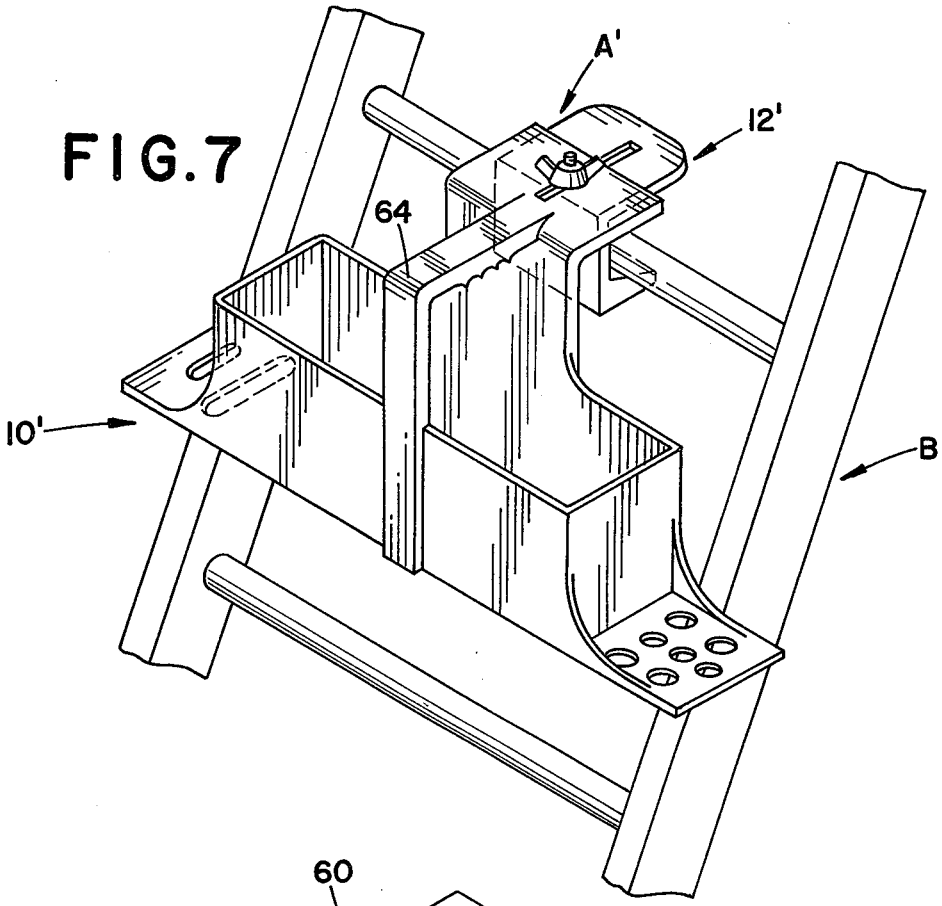
FIG. 7 is a perspective view of the alternative embodiment of the invention illustrated in FIGS. 5 and 6 shown in position on a conventional extension ladder.
Figure 8:
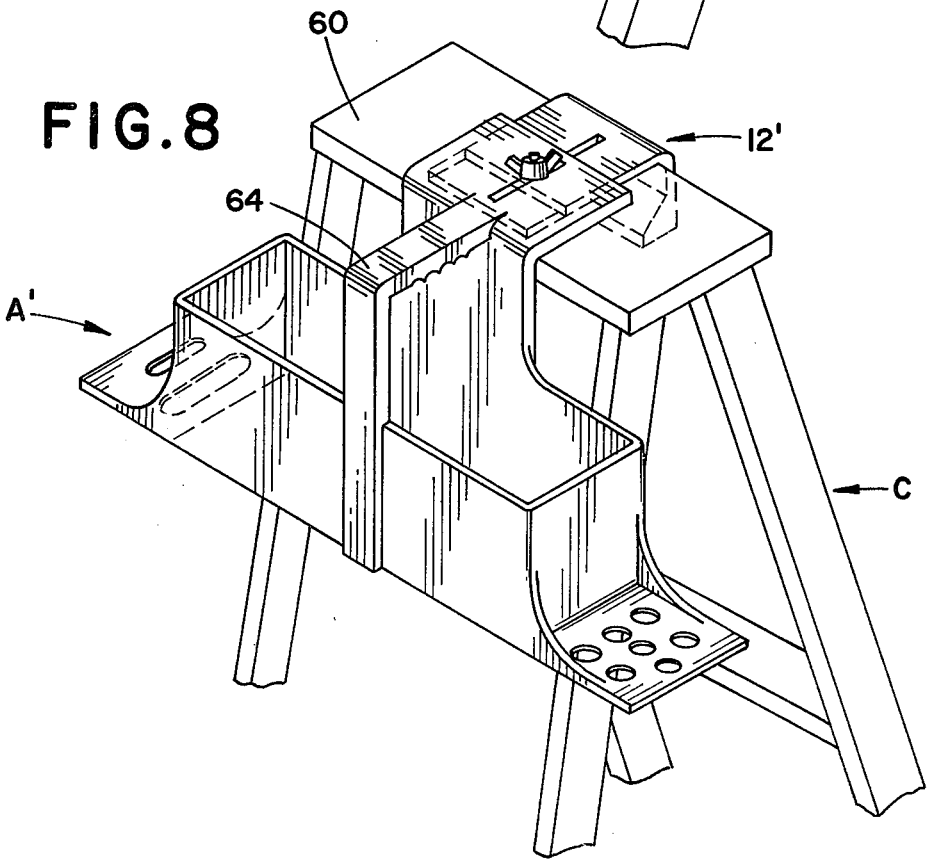
FIG. 8 is a perspective view of the alternative embodiment of the invention showing it in position on a conventional step ladder.

With particular reference to FIGS. 5 through 8, an alternative embodiment of the invention is there shown. Like components are identified by like numerals with the addition of a primed (') suffix and new components are identified by new numerals. A handhold or handle 64 for portable transport of the ladder caddy A' depends from the outer side wall 16' of container member 10' and the first support shoulder 36' and first support flange 38'. Handle 64 facilitates carrying the ladder caddy A' to and from the ladder and up and down the ladder. A tapered retaining lip 66 is included with clamp second portion 40 to effect a substantially close abutting relationship between second support flange 44', second support shoulder 42', retaining lip 66 and a rung of an extension ladder, or step of a step ladder of a variety of dimensions. With particular reference to FIG. 7, it may be seen that clamping member 12' may be mounted to a rung of an extension ladder B such that tapered retaining lip 66 is generally directed towards container member 10'. Retaining lip 66 tends to inhibit accidental removal of the ladder caddy A' from the ladder B.

The invention has been described with reference to the preferred embodiments. Obviously, modifications and alterations will occur to others upon the reading and understanding of the specification. It is my intention to include all such modifications and alterations insofar as they come within the scope of the appended claims or the equilvalents thereof.

It is now claimed:

1. A container and clamping device for a ladder comprising:

a container member configured for containing work implements, and including side edge portions comprising first and second outwardly extending panels adapted to engage ladder side rails;

a clamping member depending from said container member and including a first portion comprising a first support shoulder and a first support flange generally normally depending therefrom, and a second portion selectively adjustable to said first portion comprising a second support shoulder generally opposite of said first support shoulder and a second support flange generally normally depending from said second support shoulder; and, means for selectively fastening said clamping member first portion to said clamping member second portion whereby said container and clamping device may be attached to a ladder.

2. The device as claimed in claim 1 wherein said first support flange includes a first extended slot and said second support flange includes a second extended slot disposed for underlying positioning to said first extended slot, said slots being configured for receiving said means for selectively fastening.

3. The device as claimed in claim 2 wherein said means for fastening comprises a threaded bolt and an associated wing nut, said nut being disposed generally away from said container member.

4. The device as claimed in claim 1 wherein said first and second panels include a plurality of ringlets for receiving tools.

5. The device as claimed in claim 1 wherein said container member includes a handle for portable transport.

6. The device as claimed in claim 1 wherein said second portion of said clamping member includes a retaining lip generally normally depending from said second support shoulder opposite of said second support flange.

7. The device as claimed in claim 1 wherein said second support flange of said second portion of said clamping member is fastened to said first portion and generally directed towards said first portion such that said clamping member is adapted to receive a step ladder.

8. The device as claimed in claim 1 wherein said second support flange of said second portion of said clamping member is fastened to said first portion and generally directed away from said first portion such that said clamping member is adapted to receive a rung of an extension ladder.

9. An adjustable ladder caddy convertible for use on a step or extension ladder comprising:

a container member including a base wall and a plurality of sidewalls for containing work implements, said base wall extending normally outwardly beyond said sidewalls and including a plurality of ringlet apertures for receiving hand tools, said container member further including a hand hold depending from said sidewalls; and, a clamping member depending from said container member and including an adjustable and reversible clamp comprising a first support flange aligned with a second support flange, said flanges including extended slots for aligning said flanges and receiving means for fastening said flanges in overlying alignment.

10. The ladder caddy as defined in claim 9 wherein said clamping member includes a tapered retaining lip at said second support flange disposed opposite of said container member.

* * * * *